US007025830B2

(12) United States Patent
Kanke

(10) Patent No.: US 7,025,830 B2
(45) Date of Patent: Apr. 11, 2006

(54) COATING APPARATUS AND METHOD

(75) Inventor: Shin Kanke, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/763,248

(22) Filed: Jan. 26, 2004

(65) Prior Publication Data

US 2004/0149206 A1 Aug. 5, 2004

(30) Foreign Application Priority Data

Jan. 24, 2003 (JP) ..... 2003-016468

(51) Int. Cl.
*B05C 11/10* (2006.01)

(52) U.S. Cl. ..... 118/681; 118/680; 118/695; 118/706

(58) Field of Classification Search ..... 118/100, 118/110, 112, 118, 881, 413, 414, 404, 405, 118/407, 409, 410, 411, 412, 429, 680, 695, 118/696, 706, 705, 704, 263, 262, 261, 256
See application file for complete search history.

(56) References Cited

U.S. PATENT DOCUMENTS

2003/0049379 A1* 3/2003 Kanke et al. ..... 427/355

FOREIGN PATENT DOCUMENTS

JP 58-4589 1/1983

* cited by examiner

*Primary Examiner*—Chris Fiorilla
*Assistant Examiner*—George Koch
(74) *Attorney, Agent, or Firm*—Young & Thompson

(57) ABSTRACT

A coating apparatus and method are disclosed in which even if poor coating occurs in a lower-layer, no poor coating occurs in an upper-layer formed on the lower-layer. A pre-wet liquid coating device is disposed between a first coating device at the upstream side of a support web conveying direction, and a second coating device disposed at the downstream side. When an uncoated portion is formed by the first coating device, a pre-wet liquid is coated by a pre-wet liquid coating device, and the coating liquid can be reliably coated by the second coating device. When the pre-wet liquid coating device is removed from the support web, first, the pre-wet liquid coating device is brought into liquid-running out state, and thereafter, removed from the support web. Accordingly, the pool of pre-wet liquid is eliminated and occurrence of a thickly coated portion on the support web can be prevented.

11 Claims, 10 Drawing Sheets

COATING APPARATUS AND METHOD

CROSS-REFERENCE TO RELATED APPLICATION

This application claims priority under 35 USC 119 from Japanese Patent Application No. 2003-16468, the disclosure of which is incorporated by reference herein

BACKGROUND OF THE INVENTION

1. Field of the Invention

The present invention relates to a coating apparatus and method, and more particularly to a coating apparatus and method in which a plurality of layers are formed on a strip-shaped base material in a state of continuously travelling.

2. Description of the Related Art

As an example of a conventional coating apparatus and method, there has been proposed a coating apparatus and method, wherein in a manufacturing process of planographic printing plates, a desired coating liquid is coated to a strip-shaped aluminum plate (a so-called aluminum web) which serves as a base material (for example, see Japanese Patent Application Publication (JP-B) No. 58-4589).

A planographic printing plate is ordinarily manufactured by the procedure in which a support web is produced by graining one surface or both surfaces of an aluminum web in accordance with an ordinary method, and an anodic oxide layer is formed on the grained surface of the support web, and thereafter, a plate making layer (that is, a lower layer) which is a single-layer or multi-layered photosensitive layer or heat-sensitive layer is formed thereon, and an antioxidant layer (that is, an upper layer) is formed on the surface of the plate making layer.

In a planographic printing plate having a multi-layered plate making layer or a planographic printing plate having an antioxidant layer on a plate making layer, generally, respective layers are formed one by one. Ordinarily, these layers are each formed by coating thereto a coating liquid such as a photosensitive-layer forming liquid containing a photosensitive resin, a heat-sensitive layer forming liquid containing a thermal polymerization resin, and an antioxidant-layer forming liquid containing, as the principal component, a polyvinyl alcohol aqueous solution, and thereafter, drying the coated coating liquid. At this time, in a case in which an uncoated portion with no photosensitive-layer forming liquid coated thereto occurs for any reason, an anodic oxide layer of the support web is exposed at the uncoated portion.

The antioxidant-layer forming liquid has excellent wettability to the photosensitive layer, but does not necessarily have much excellent wettability to the antioxidant film. However, in conventional coating apparatuses and methods, even if the uncoated portion exists, the antioxidant-layer forming liquid is continuously coated in this state. Therefore, there exists a problem that poor coating of the antioxidant-layer forming liquid occurs in the uncoated portion, thereby resulting in the antioxidant-layer forming liquid be nonuniformly coated. Then, if once poor coating of the antioxidant-layer forming liquid occurs, even when poor coating in the photosensitive-layer forming liquid is solved and the photosensitive-layer forming liquid is normally coated, poor coating of the antioxidant-layer forming liquid cannot be solved.

SUMMARY OF THE INVENTION

In view of the above-described circumstances, it is an object of the present invention to provide a coating apparatus and method in which even if poor coating occurs in a lower layer, no poor coating occurs in an upper layer formed on the lower layer.

A first aspect of the present invention is a coating apparatus which forms a plurality of layers on a continuously travelling base material, comprising: an upstream-side coating section which coats (applies) a first coating liquid to the base material to form a lower layer; a downstream side coating section disposed at the downstream side of the upstream-side coating section in a direction to which the base material is conveyed, and coating (applying), onto the lower layer, a second coating liquid of which composition is the same as or different from that of the first coating liquid, to thereby form an upper layer; an undercoat liquid coating section disposed so as to move close to or away from the base material, when an uncoated portion, which is a portion to which no first coating liquid is coated, is generated at a time of forming the lower layer, the undercoat liquid coating section being contacted the base-material before the uncoated portion reaches the undercoat liquid coating section and coating (applying) an undercoat liquid to the uncoated portion, and when coating of the first coating liquid is restarted, the undercoat liquid coating section being removed from the base material after a lower layer formed again reaches the undercoat liquid coating section and stopping coating of the undercoat liquid; and a liquid run-out section which, at the latest, just before the undercoat liquid coating section is removed from the base material, stops coating of the undercoat liquid for the base material by making the undercoat liquid coating section into a state of running out of the liquid.

In the above-described coating apparatus, the first coating liquid is coated to the base material by the upstream-side coating section to thereby form the lower layer, and thereafter, the second coating liquid is coated to the lower layer by the downstream-side coating section to thereby form the upper layer. In this case, when an uncoated portion is generated on the base material due to poor coating by the upstream-side coating section, the undercoat liquid coating section contacts the base material and coats thereto the undercoat liquid before the uncoated portion reaches the undercoat liquid coating section. Subsequently, the uncoated portion passes through the downstream-side coating section. At this time, the uncoated portion is coated with the undercoat liquid by the undercoat liquid coating section, and therefore, the second coating liquid is favorably coated to the base material (the undercoat liquid). That is, according to this coating apparatus, even if an uncoated portion is generated in the lower layer due to poor coating by the upstream-side coating section, poor coating of the upper layer resulting from the uncoated portion does not occur.

When the upstream-side coating section restarts the coating of the first coating liquid and the lower layer is formed again (that is, the uncoated portion is eliminated), the undercoat liquid coating section is removed from the base material after the again formed lower layer reaches the undercoat liquid coating section, thereby the coating of the undercoat liquid is stopped. As a result, excessive coating of the undercoat liquid is prevented, and a lower amount of the undercoat liquid is used therefore the undercoat liquid can be efficiently coated.

At the latest just before the undercoat liquid coating section is removed from the base material, the liquid run-out section makes the undercoat liquid coating section into a state of running out of the liquid, thereby stopping the coating of the undercoat liquid for the base material. For this reason, when the undercoat liquid coating section is removed from the base material, the pool of liquid of the undercoat liquid coating section does not adhere to the base material, and formation of a thickly coated portion of the undercoat liquid on the base material, resulting from the pool of liquid, is prevented.

The base material to be coated by the coating apparatus of the present invention is not particularly limited so long as it has coating liquid (the first coating liquid and the second coating liquid) coated to the surface thereof. Flexible strip-shaped materials having the shape of a thin plate or a film are frequently used. Specific examples thereof include, in addition to an aluminum web used as a support of a planographic printing plate, a film base of photographic recording material such as a photographic film or a movie film, baryta-coated paper (photographic base paper) for photographic printing paper, a base material used for magnetic recording material, such as polyester film, which is used for magnetic recording materials such as recording tape, video tape, and floppy disk (R), a metallic thin plate for a coat-metal plate such as color steel sheet iron, and the like. These base materials may also be subjected to various treatment, for example, graining and anodic oxidation treatment for an aluminum web for a planographic printing plate.

The lower layer may be formed directly on the base material, or may also, be placed over another layer formed on the base material.

The first coating liquid and the second coating liquid may have the same composition or may have different compositions.

As the upstream-side coating section, a coating device can be used, which is ordinarily used to coat, to the base material, a liquid solution or suspension which is as the first coating liquid.

As the above-mentioned coating device, a bar coater which performs coating by using a coating bar, such as a grooved bar with circumferential grooves formed on the surface thereof, or a wire bar with a metallic thin wire wound thereon; a rod coater which performs coating by using a coating rod having a flat and smooth surface; and the like can be used. Further, a non-contact type coating device which coats a coating liquid without making contact with the base material, for example, a die coater, a curtain coater, and an extrusion coater, can also be used.

As the downstream-side coating section, various coating devices which can be used as the upstream-side coating section can be used. However, the non-contact type coating device is preferably used because it allows coating of the second coating liquid without damaging the lower layer.

As the undercoat liquid to be coated by the undercoat liquid coating section, a liquid which improves wettability between the base material and the second coating liquid is exemplified.

Further, the undercoat liquid preferably has a surface tension equal to or greater than that of the second coating liquid for the reason that poor coating such as coating streaks or liquid run-out does not occur when the second coating liquid is coated to a portion coated with the undercoat liquid.

As the undercoat liquid, a liquid including, as the principal component, a main solvent of the second coating liquid can be used, and a surface-active agent solution can also be used. As the solvent of the surface-active agent solution, the main solvent of the second coating liquid is preferably used. Particularly, when the main solvent of the second coating liquid is water, preferably, an aqueous solution including a surface-active agent is used as the undercoat liquid, thereby allowing the undercoat liquid to be uniformly spread over the uncoated portion. The concentration of the surface-active agent in the surface-active agent solution is preferably micell concentration or more. When the second coating liquid includes the surface-active agent, the undercoat liquid also preferably includes similar surface-active agent.

The amount of the undercoat liquid coated by the undercoat liquid coating section can be determined in accordance with the widthwise dimension of the base material and the composition of the undercoat liquid. Preferably, the amount of a water-based undercoat liquid coated is 6 $cm^3/m^2$ or more, and the amount of an organic solvent-based undercoat liquid coated is 2 $cm^3/m^2$ or more, thereby allowing the undercoat liquid to be coated to the entire surface of the base material.

The "coating" of the undercoat liquid mentioned in the present invention means that the undercoat liquid is coated to a surface of the base material to be coated in some way or other. Specifically, it is not limited to ordinary coating of undercoat liquid, and there may be used a method in which an undercoat liquid is coated to the base material in such a manner as to be dripped from an injection syringe or the like, or a method in which an undercoat liquid is coated to the base material in such a manner as to be injected from an injector.

As the undercoat liquid coating section, an undercoat liquid coating device which coats the undercoat liquid to the base material is shown. Examples of the undercoat liquid coating device include an undercoat liquid coating head which extrudes, toward the base material, an undercoat liquid in the shape of a strip and coats the same to the base material a coating bar such as a grooved bar with circumferential grooves formed on the surface thereof, or a wire bar with a metallic thin wire wound thereon, and the like.

Examples of the undercoat liquid coating head include: a slide bead-type coater having the same structure as that of the above-described die coater; a curtain-type coater having the same structure as that of the above-described curtain coater; an extrusion-type coater having the same structure as that of the above-described extrusion coater; and the like.

In addition, an undercoat liquid injection syringe which coats the undercoat liquid to the surface of the base material in drops, and the like are also used as the undercoat liquid coating section.

The liquid run-out section described in the first aspect of the present invention is not particularly limited so long as, by making the undercoat liquid coating section into a state of running out of the liquid, it does allow the pool of liquid of the undercoat liquid coating section to adhere to the base material when the undercoat liquid coating section is removed from the base material, and can prevent formation of a thickly coated portion of the undercoat liquid on the base material, resulting from the pool of undercoat liquid. For example, the structure described in a second aspect of the present invention, in which the liquid run-out section is formed as a liquid-supply stopping section which makes the undercoat liquid coating section into a state of running out of the liquid by stopping supply of the liquid to the undercoat liquid coating section, or the structure described in a third aspect of the present invention, in which the above-described undercoat liquid coating section is formed as a bar coating device having an undercoating bar which rotates in contact with the base material to coat the undercoat liquid thereto, and the liquid run-out section is formed as a speed reducer which decreases the number of rotation of the undercoating bar to thereby make the bar coating device into a state of running out of the liquid, can be used. In either case, the undercoat liquid coating section can be reliably brought into a state of running out of the liquid by a simple structure.

In the structure according to the third aspect of the present invention, even in a case in which the number of rotation of the undercoating bar is reduced, if only the undercoating bar is not completely stopped, biased abrasion generated by the undercoating bar partially rubbing against the base material can be prevented.

In a fourth aspect of the present invention, in the structure of the above-described first to third aspects, the apparatus further comprises an uncoated-portion detecting section which detects occurrence of the uncoated portion at the time of forming the lower layer, and the undercoat liquid coating section coats the undercoat liquid to the uncoated portion when the uncoated-portion detecting section detects occurrence of the uncoated portion.

When the uncoated portion is detected by the uncoated portion detecting section the undercoat liquid is coated to the base material by the undercoat liquid coating section. For this reason, the undercoat liquid can be reliably coated to the uncoated portion. Further, with no undercoat liquid coated to a region in which the lower layer is formed, a lower amount of the undercoat liquid is used and can be efficiently coated.

A fifth aspect of the present invention according to the first aspect further comprises: a signal output section which outputs a signal relating to generation of the uncoated portion and a signal relating to restarting of coating of the first coating liquid; a calculating section which, based on the signal from the signal output section, calculates a timing at which the uncoated portion reaches the undercoat liquid coating section and a timing at which the lower layer formed again reaches the undercoat liquid coating section; and a control section which, based on the calculating result of the calculating section, instructs coating the undercoat liquid on the uncoated portion or stopping of coating the undercoat liquid.

In a sixth aspect of the present invention according to the first aspect, the upstream-side coating section is disposed so as to move close to or away from the base material.

In a seventh aspect of the present invention according to the sixth aspect, the signal relating to generation of the uncoated portion and the signal relating to restarting of coating of the first, coating liquid are a removal signal indicating the upstream-side coating section being away from the base material and a contact signal indicating the upstream-side coating section contacting the base material.

In an eighth aspect of the present invention according to the third aspect, the speed reducer makes the bar coating device into a state of running out of the liquid without stopping rotating of the undercoating bar.

A ninth aspect of the present invention is a coating apparatus which forms a plurality of layers on a continuously travelling base material, comprising: an upstream-side coating section which coats a first coating liquid to the base material to form a lower layer; a downstream-side coating section disposed at the downstream side of the upstream-side coating section in a direction to which the base material is conveyed, and coating, onto the lower layer, a second coating liquid of which composition is the same as or different from that of the first coating liquid, to thereby form an upper layer; an undercoat liquid coating section disposed between the downstream-side coating section and the upstream-side coating section in the direction to which the base material is conveyed, the undercoat liquid coating section, when an uncoated portion, which is a portion to which no first coating liquid is coated, is generated at a time of forming the lower layer, coating the undercoat liquid to the uncoated portion.

In a tenth aspect of the present invention according to the ninth aspect, the apparatus further comprises an uncoated-portion detecting section which detects occurrence of the uncoated portion at the time of forming the lower layer, and the undercoat liquid coating section coats the undercoat liquid to the uncoated portion when the uncoated portion detecting section detects occurrence of the uncoated portion.

An eleventh aspect of the present invention is a coating method in which a plurality of layers are formed on a strip-shaped base material in a state of continuously travelling, wherein, when a first coating liquid is coated to the base material to form a lower layer, and a second coating liquid of which composition is the same as or different from that of the first coating liquid is coated onto the lower layer to thereby form an upper layer, if an uncoated portion, which is a portion to which no first coating liquid is coated, is generated at a time of forming the lower layer, an undercoat liquid is coated to the uncoated portion by making an undercoat liquid coating section, which coats the undercoat liquid to the uncoated portion, into contact with the uncoated portion, and if the lower layer is formed again, coating of the undercoat liquid is stopped by the undercoat liquid coating section being removed from the base material, and, at the latest, just before the undercoat liquid coating section is removed from the base material, coating of the undercoat liquid for the base material is stopped by making the undercoat liquid coating section into a state of running out of the liquid, In the above-described coating method, the first coating liquid is coated to the base material to thereby form a lower layer, and thereafter, a second coating liquid is coated to the lower layer to thereby form an upper layer. When an uncoated portion is form ed on the base material due to poor coating at the time of forming the lower layer, the undercoat liquid coating section makes contact with the base material and coats the undercoat liquid to the uncoated portion. Since the undercoat liquid is coated to the uncoated portion, the second coating liquid is favorably coated to the base material (the first coating liquid). That is, according to this coating method, even if the uncoated portion is generated in the lower layer due to poor coating, poor coating of the upper layer resulting from the uncoated portion does not occur.

When the lower layer is formed again (the uncoated portion is eliminated), the undercoat liquid coating section is removed from the base material and stops coating of the undercoat liquid. Accordingly, excessive coating of the undercoat liquid is prevented, and coating of a lower amount of the undercoat liquid can be efficiently carried out.

At the latest just before the undercoat liquid coating section is removed from the base material, the coating of the undercoat liquid for the base material is stopped by making the undercoat liquid coating section in a state of running out of the liquid. For this reason, when the undercoat liquid coating section is removed from the base material, no pool of the liquid of the undercoat liquid coating section is applied to the base material, and the formation of a thickly coated portion of the undercoat liquid on the base material, resulting from the pool of the liquid, is prevented.

Incidentally, as the "base material" "first coating liquid", "second coating liquid", and "undercoat liquid" mentioned in the fifth aspect, the similar structures of those described in the first aspect can be applied.

Further, the expression "at the latest just before the undercoat liquid coating section is removed from the base material" recited in the first and fifth aspects means that before the undercoat liquid coating section is removed from the base material to such an extent that the pool of liquid of the undercoat liquid coating section can be eliminated, as described above. Accordingly, as long as this condition is satisfied, it suffices that a timing at which the undercoat liquid coating section is brought into a state of running out of the liquid is set before a timing at which the undercoat liquid coating section is removed from the base material. However, if there is a long time, to a tome at which the undercoat liquid coating section is removed from the base material from a time at which the undercoat liquid coating section is brought into a state of running out of the liquid, the undercoat liquid coating section is merely made in contact with the base material without coating thereto the undercoat liquid during that period of time. Accordingly, the above-described period of time is preferably shortened.

BRIEF DESCRIPTION OF THE DRAWINGS

FIG. 7A shows a case in which the pre-wet liquid is coated; and FIG. 7B shows a case in which no pre-wet liquid is coated.

DETAILED DESCRIPTION OF THE INVENTION

Figure 1:
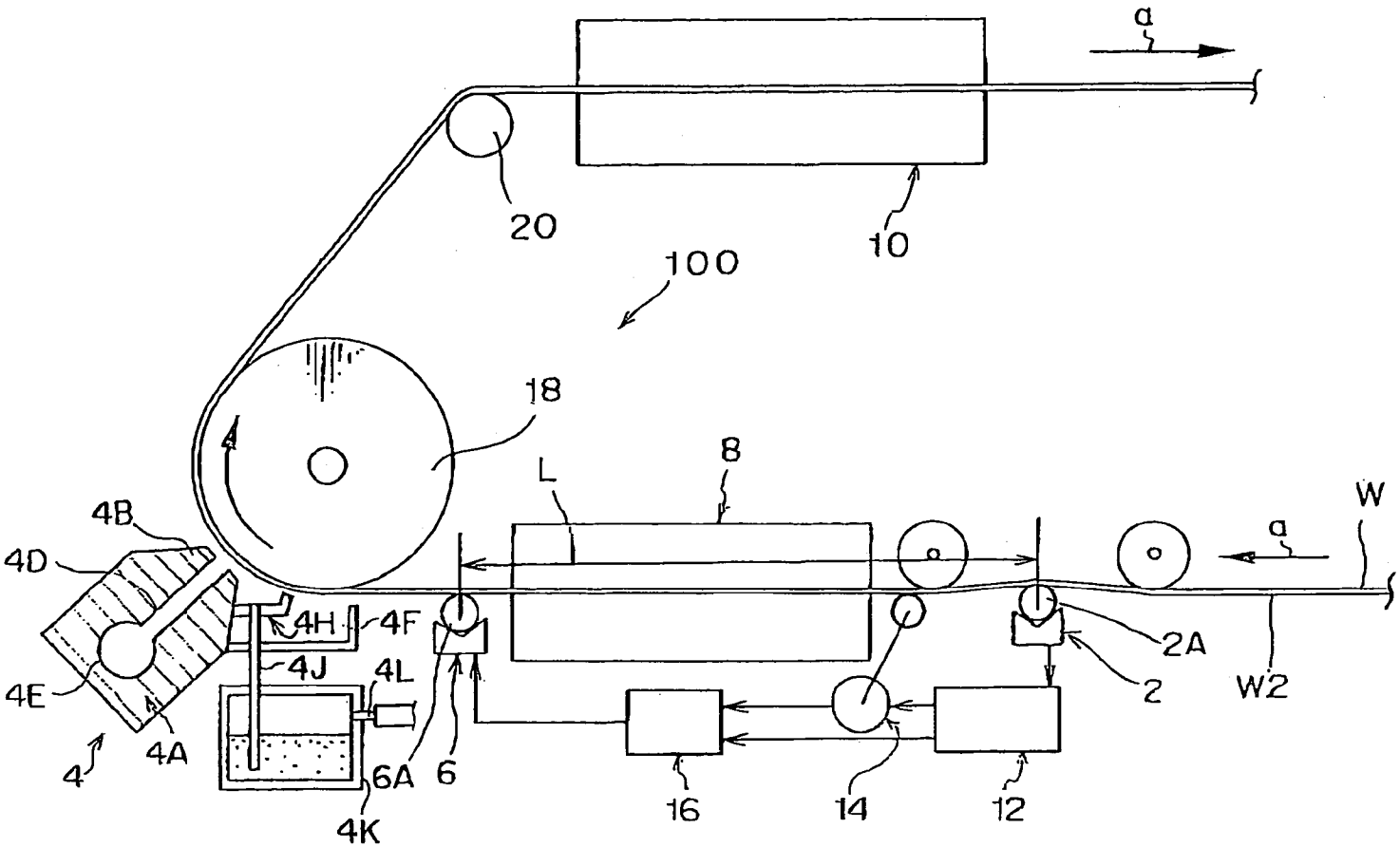
FIG. 1 is a schematic diagram showing a coating apparatus according to a first embodiment of the present invention.

FIG. 1 shows a coating apparatus 100 according to an embodiment of the present invention. The coating apparatus 100 is an example of coating apparatus used to form a photosensitive layer on a support web W which is a support of a planographic printing plate and also form an antioxidant layer (or an antioxidant coating film) on the surface of the photosensitive layer.

In this coating apparatus 100, the support web W is adapted to continuously travel along a fixed conveying direction indicated by arrow a, and a first coating device 2, a pre-wet liquid coating device 6, and a second coating device 4 are disposed sequentially from the upstream side of the conveying direction.

The first coating device 2 is provided so as to form a photosensitive layer L1 by coating, to the support web W, a photosensitive-layer forming liquid corresponding to the first coating liquid of the present invention. The second coating device 4 is provided so as to form an antioxidant layer L2 by coating, to the photosensitive layer L1, an antioxidant-layer forming liquid corresponding to the second coating liquid of the present invention. The pre-wet liquid coating device 6 is provided adjacently at the upstream of the second coating device 4. When an uncoated portion is generated on the photosensitive layer L1, an undercoat liquid, that is, a pre-wet liquid is coated to the uncoated portion. The first coating device 2, the second coating device 4, and the pre-wet liquid coating device 6 correspond to upstream-side coating section, downstream-side coating section, and undercoat liquid coating section, respectively, in the coating apparatus of the present invention.

A backup roller 18 is provided in the vicinity of the second coating device 4, which backup roller transports the support web W by rotating in a clockwise direction shown in FIG. 1.

A photosensitive layer drying device 8 of a hot-air drying type is provided between the first coating device 2 and the pre-wet liquid coating device 6 to dry the photosensitive layer L1 formed by the first coating device 2. An antioxidant-layer drying device 10 of a hot air drying type is provided at the downstream side of the second coating device 4 to dry the antioxidant-layer formed by the second coating device 4.

A guide roller 20 is provided in the vicinity of an inlet of the antioxidant-layer drying device 10 to guide the support web W to the inlet of the antioxidant layer drying device 10.

The coating apparatus 100 also includes a removal/contact signal generating section 12, an encoder 14 and a pre-wet liquid coating device control section 16. The removal/contact signal generating section 12 is provided so as to generate a removal signal when a bar 2A (described later) of the first coating device 2 is removed from the support web W. The encoder 14 is made to operate in response to a removal signal from the removal/contact signal generating section 12 and measure the distance of the support web W travelling after the bar 2A of the first coating device 2 is removed from the support web W. Further, the pre-wet liquid coating device control section 16 is provided so as to start operating in response to a removal signal from the removal/contact signal generating section 12, and when receiving, from the encoder 14, a signal indicating that the uncoated portion formed on the support web W is moved close to the pre-wet liquid coating device 6, output an instruction to the pre-wet liquid coating device 6 so as to carry out coating of the pre-wet liquid.

Next, a description will be given in detail of respective components of the coating apparatus 100.

Figure 2:
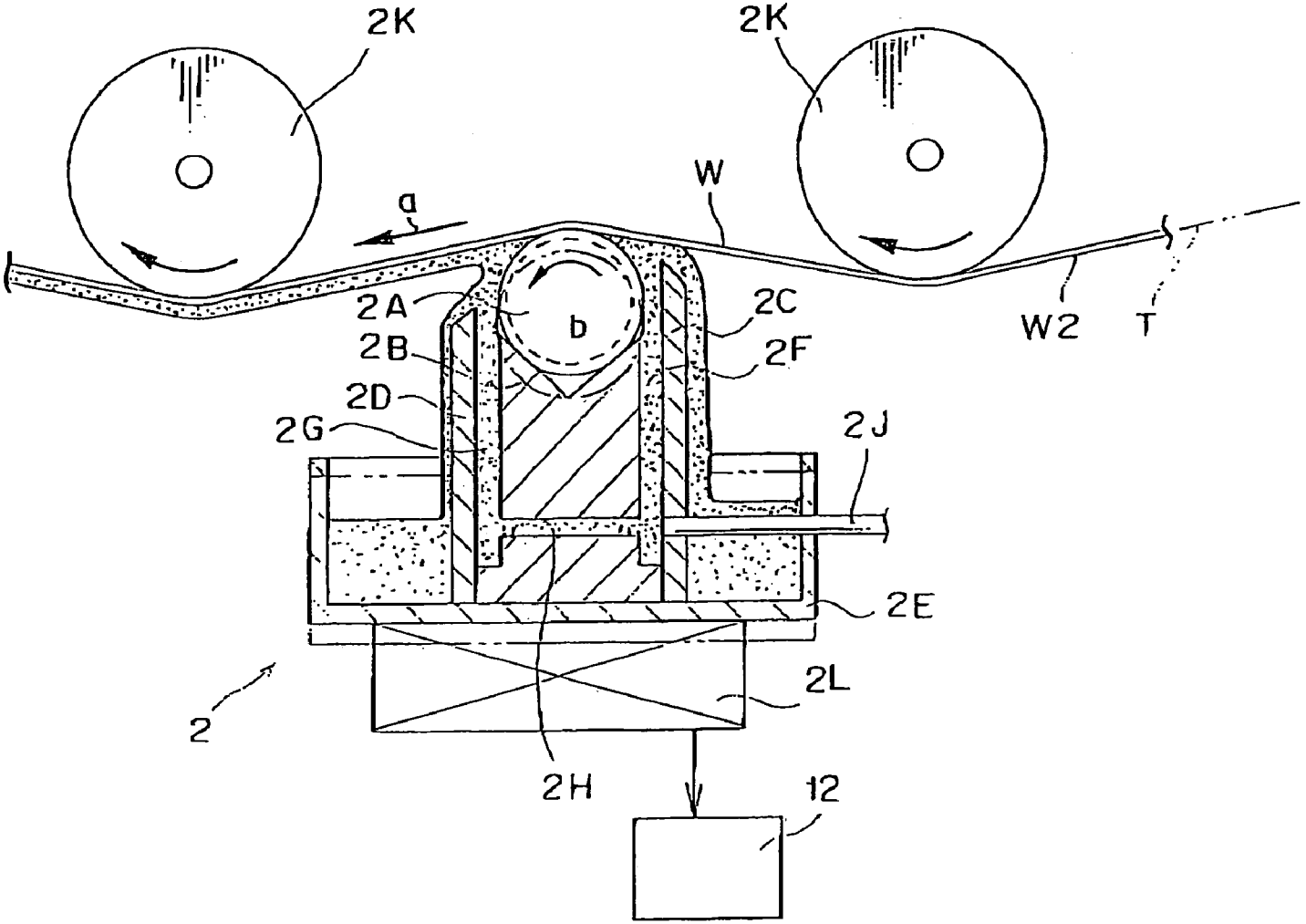
FIG. 2 is a partially enlarged view showing the structure of a first coating device which forms the coating apparatus according to the first embodiment of the present invention.

As shown in FIG. 2, the first coating device 2 is provided with the bar 2A which rotates in the same direction as the conveying direction a of the support web W (that is, the direction indicated by arrow b) while contacting a roughened surface W2 of the support web W; a plate-shaped bar supporting member 23 which supports the bar 2A from a lower side by a V-shaped groove formed on the top surface thereof; an upstream-side shuttering (weir) board 2C formed upright at the upstream side of the bar supporting member 2B and extending vertically toward a travel side surface T which is a travel path of the support web W; a downstream-side shuttering (weir) board 2D formed upright at the downstream side of the bar supporting member 2B and extending vertically toward the travel side surface T which is a travel path of the support web W; and a base 2E on which the bar supporting member 2B, the upstream-side shuttering board 2C and the downstream-side shuttering board 2D are fixed. That is, the first coating device 2 is formed as a so-called bar coater.

An upstream-side liquid supplying passage 2F for supplying a photosensitive-layer forming liquid to the upstream side of the bar 2A is provided between the bar supporting member 2B and the upstream-side shuttering board 2C. A downstream-side liquid supplying passage 2G for supplying a photosensitive-layer forming liquid to the downstream side of the bar 2A is provided between the bar supporting member 2B and the downstream-side shuttering board 2D. The upstream-side liquid supplying passage 2F and the downstream-side liquid supplying passage 2G communicate with each other by a communicating passage 2H provided at a lower portion of the bar supporting member 2B.

A liquid supplying pipe line 2J for supplying the photosensitive-layer forming liquid is connected to a lower end of the upstream-side liquid supplying passage 2F.

One pair of web pressing rollers 2K are disposed above the travel side surface T, which rollers are provided so as to press the support web W toward the bar 2A in such a manner as to be driven to rotate around its axis at the time of coating the photosensitive-layer forming liquid.

A lifting device 2L for moving up and down the base 2E is provided below the base 2E. When poor coating occurs in the first coating device 2 to form an uncoated portion on the support web W the lifting device 2L functions to move down the base 2E to remove the bar 2A from the support web W, and at the same time, output, to the removal/contact signal generating section 12, a signal indicating that the base 2E was moved down (falling signal), as shown in FIG. 1. Further, when coating is restarted in the first coating device 2 by moving up the base 2E and the uncoated portion is eliminated, the lifting device 2L outputs, to the removal/contact signal generating section 12, a signal indicating that the base 2E was moved up (rising signal) when the removal/contact signal generating section 12 receives these signals from the lifting device 2L, it generates a removal signal or a contact signal, and outputs to the encoder 14 and the pre-wet liquid coating device control section 16. In FIG. 2, the state in which the bar 2A is removed from the support web W by moving down the base 2E is indicated by the two-dot chain line.

As the lifting device 2L, a ball screw-type lifting device for moving up and down the base 2B using a ball screw, a hydraulic cylinder-type lifting device for moving up and down using a hydraulic cylinder, a pneumatic cylinder-type lifting device for moving up and down using a pneumatic cylinder are used.

As the bar 2A, a grooved bar on which circumferential grooves are formed on the surface thereof at fixed intervals, or formed closely, a wire bar on which a thin metal wire is wound onto the surface thereof, and the like are used.

Figure 3:
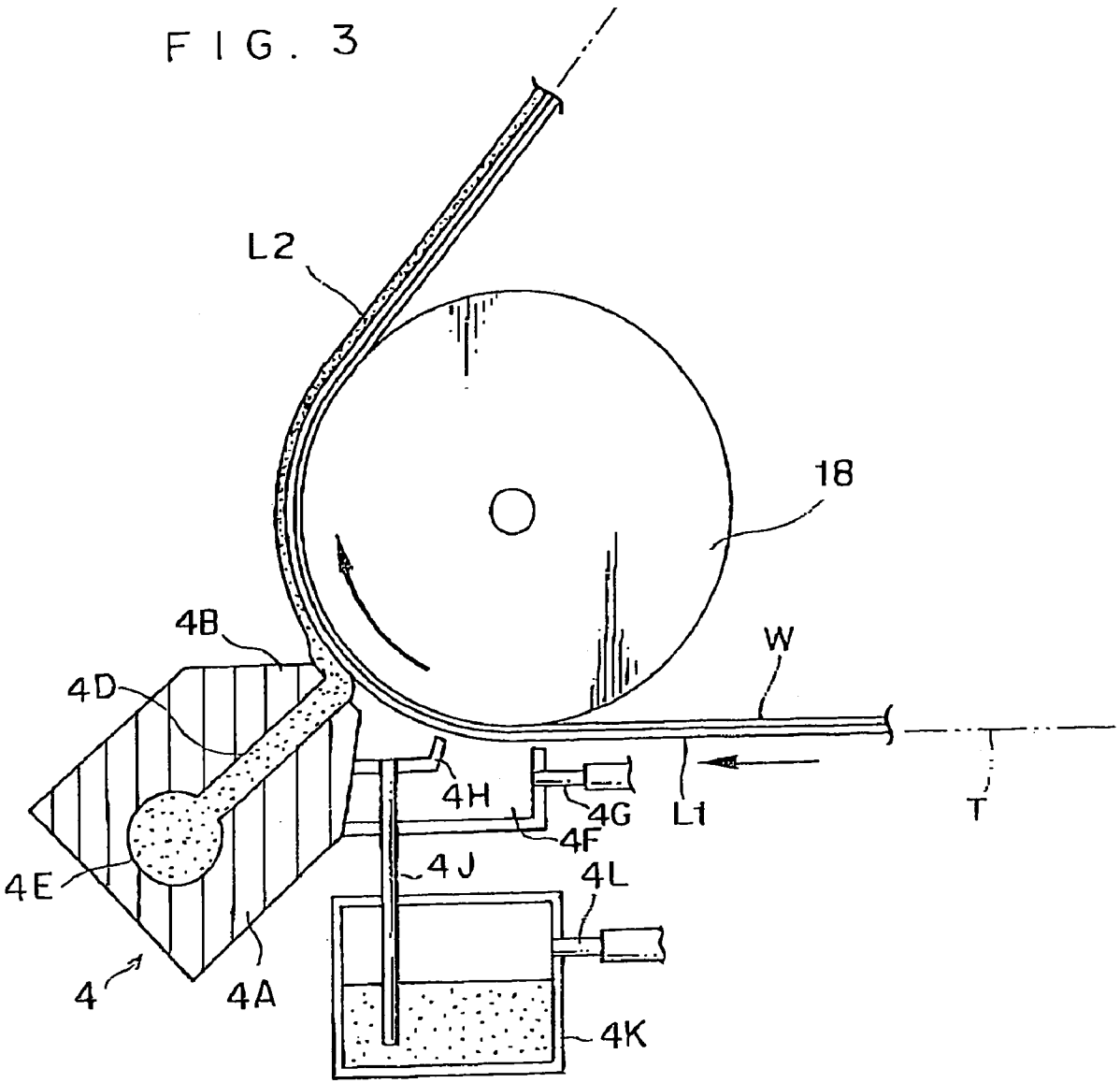
FIG. 3 is a partially enlarged view showing the structure of a second coating device which forms the coating apparatus according to the first embodiment of the present invention.

When the photosensitive-layer forming liquid is coated, the bar 2A abuts against the support web W at a portion between the grooves formed on the surface or at a wire portion wound over the surface, and a passage of the photosensitive-layer forming liquid is formed between the groove or a concave portion formed between the wire portions (wire bars) and the support web W. The photosensitive-layer forming liquid is coated in a predetermined thickness FIG. 3 shows in detail the second coating device 4 and its vicinities.

The second coating device 4 includes a die coater body 4A having a block-shaped configuration of a substantially rectangular parallelepiped.

The die coater body 4A protrudes toward the backup roller 18 wedgewise, and has an end portion 4B including an end edge parallel to the surface of the backup roller 18. The end portion 4B is formed so that a clearance of, usually, about 0.1 to 1 mm is produced between the end edge and the support web W wound onto the backup roller 18 and passing near the second coating device 4. The size of this clearance can be determined depending on the thickness of the antioxidant layer L2 to be formed on the support web W.

A discharge slit 4D which is a slit-shaped passage is provided within the die coater body 4A and the above-described antioxidant-layer forming liquid is discharged. The discharge slit 4D has an opening extending along a transverse direction of a travel side surface T and a lower end thereof communicates with a liquid supplying passage 4E for supplying the antioxidant-layer forming liquid to the discharge slit 4D.

A decompression chamber 4F is provided below the end portion 4B and a decompression tube 4G for reducing the pressure of an interior of the chamber is connected to the bottom of the decompression chamber 4F. A gutter-shaped excess liquid receiver 4H is provided within the decompression chamber 4F to receive an excess portion of the antioxidant-layer forming liquid discharged from the discharge slit 4D, which was not coated to the support web W. A drainage tube 4J extends downward from the excess liquid receiver 4H to lead out the excess antioxidant-layer forming liquid. A drainage reservoir 4K is provided at the lower end of the drainage tube 4J and the antioxidant-layer forming liquid discharged through the drainage tube 4J is stored therein. A decompression tube 4L for reducing the pressure of the interior of the reservoir is also connected to the drainage reservoir 4K.

The second coating device 4 having the above-described structure is entirely formed as a so-called die coater.

When the antioxidant-layer forming liquid is coated to the support web W, the interior of the decompression chamber 4F is reduced pressure to, for example, 50 to 1000 Pa by a vacuum pump or an aspirator connected to the decompression tube 4G. Further, the interior of the drainage reservoir 4K is also reduced pressure by the decompression tube 4L to a pressure nearly equal to that of the interior of the decompression chamber 4F.

In the above-described state, the antioxidant-layer forming liquid is discharged from the discharge slit 4D and made to flow toward the end edge of the end portion 4B. Then, by forming a coating bead between the end edge of the end portion 4B and the photosensitive layer L1 of the support web W, the antioxidant-layer forming liquid is coated to the support web W to thereby form an antioxidant layer L2.

Figure 4:
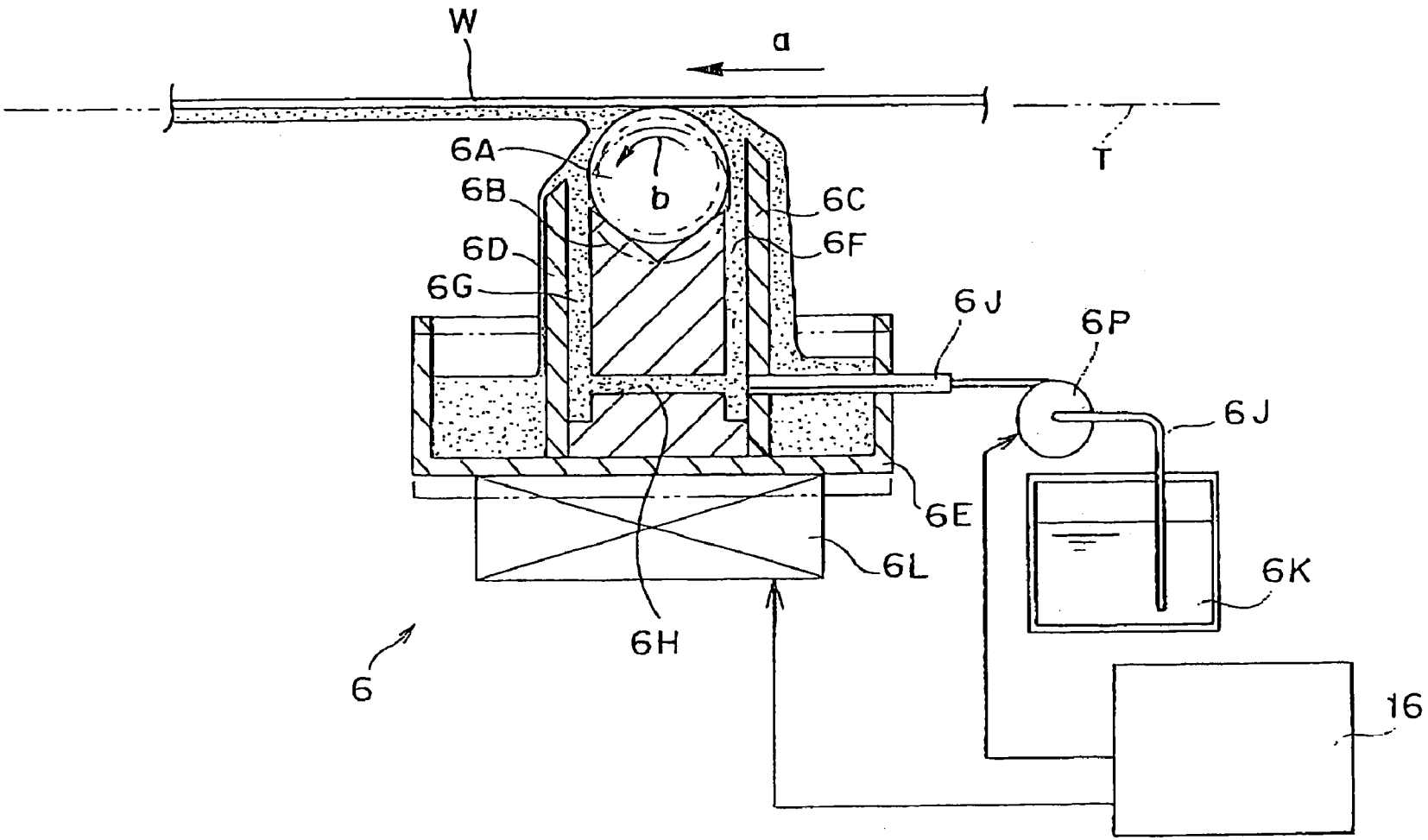
FIG. 4 is a partially enlarged view showing the structure of a pre wet liquid coating device which forms the coating apparatus according to the first embodiment of the present invention, in a state in which the pre-wet liquid is coated.

FIG. 4 shows the structure of a pre-wet liquid coating device 6.

The pre-wet liquid coating device 6 is formed as the same bar coating device (bar coater) as the first coating device 2.

That is, the pre-wet liquid coating device 6 is provided with: a bar 6A which rotates in the same direction as the conveying direction a of the support web W, as indicated by arrow b in FIG. 2, while abutting against the roughened surface W2 of the support web W; a plate-shaped bar supporting member 6B which supports the bar 6A from the lower side by a V-shaped groove formed on the top surface thereof; an upstream-side shuttering board 6C formed upright at the upstream side of the bar supporting member 6B and extending in the vertical direction toward the travel side surface T which is the travel path of the support web W; a downstream-side shuttering board 6D formed upright at the downstream side of the bar supporting member 6B and extending in the vertical direction toward the travel side surface T which is the travel path of the support web W; and a base 6E on which the bar supporting member 6B, the upstream-side shuttering board 6C, and the downstream-side shuttering board 6D are fixed.

Further, an upstream-side liquid supplying passage 6F for supplying a photosensitive-layer forming liquid to the upstream side of the bar 6A is provided between the bar supporting member 6B and the upstream-side shuttering board 6C, and a downstream-side liquid supplying passage 6G for supplying a photosensitive-layer forming liquid to the downstream side of the bar 6A is provided between the bar supporting member 6B and the downstream-side shuttering board 6D. The upstream-side liquid supplying passage 6 and the downstream-side liquid supplying passage 6G communicate with each other by a communicating passage 6H provided at a lower portion of the bar supporting member 6B.

A liquid supplying pipe line 6J is connected to a lower end of the upstream-side liquid supplying passage 6F so as to supply the photosensitive-layer forming liquid from a pre-wet liquid tank 6K. The liquid supplying pipe line 6J is equipped with a liquid-supply pump 6P which supplies the pre-wet liquid toward the upstream-side liquid supplying passage 6F, the downstream-side liquid-passage 6G, and the communicating passage 6H. The liquid-supply pump 6P is controlled so as to be driven by the pre-wet liquid coating device control section 16. In place of the liquid-supply pump 6P, liquid-supply bellows which supplies out the pre-wet liquid may be used.

A lifting device 6L which moves up and down the base 6B is provided below the base 6E, and is controlled so as to be driven by the pre-wet liquid coating device control section 16. When a removal signal is inputted to the pre-wet liquid coating device control section 16, which signal is generated in the removal/contact signal generating section 12 when poor coating occurs in the first coating device 2, the pre-wet liquid coating device control section 16 outputs, to the lifting device 6L, a drive signal indicating to start coating of the pre-wet liquid, so that the bar 6A of the pre-wet liquid coating device 6 contacts the support web W before an uncoated portion generated on the support web W arrives at the pre-wet liquid coating device 6. The lifting table 6E moves upward from a state which is indicated by the two-dot chain line in FIG. 4, and the bar 6A moves close to the support web W. Subsequently, the liquid-supply pump 6P operates, and the pre-wet liquid stored in the pre-wet liquid tank 6K is supplied to the bar 6A and also coated to the support web W.

Figure 5:
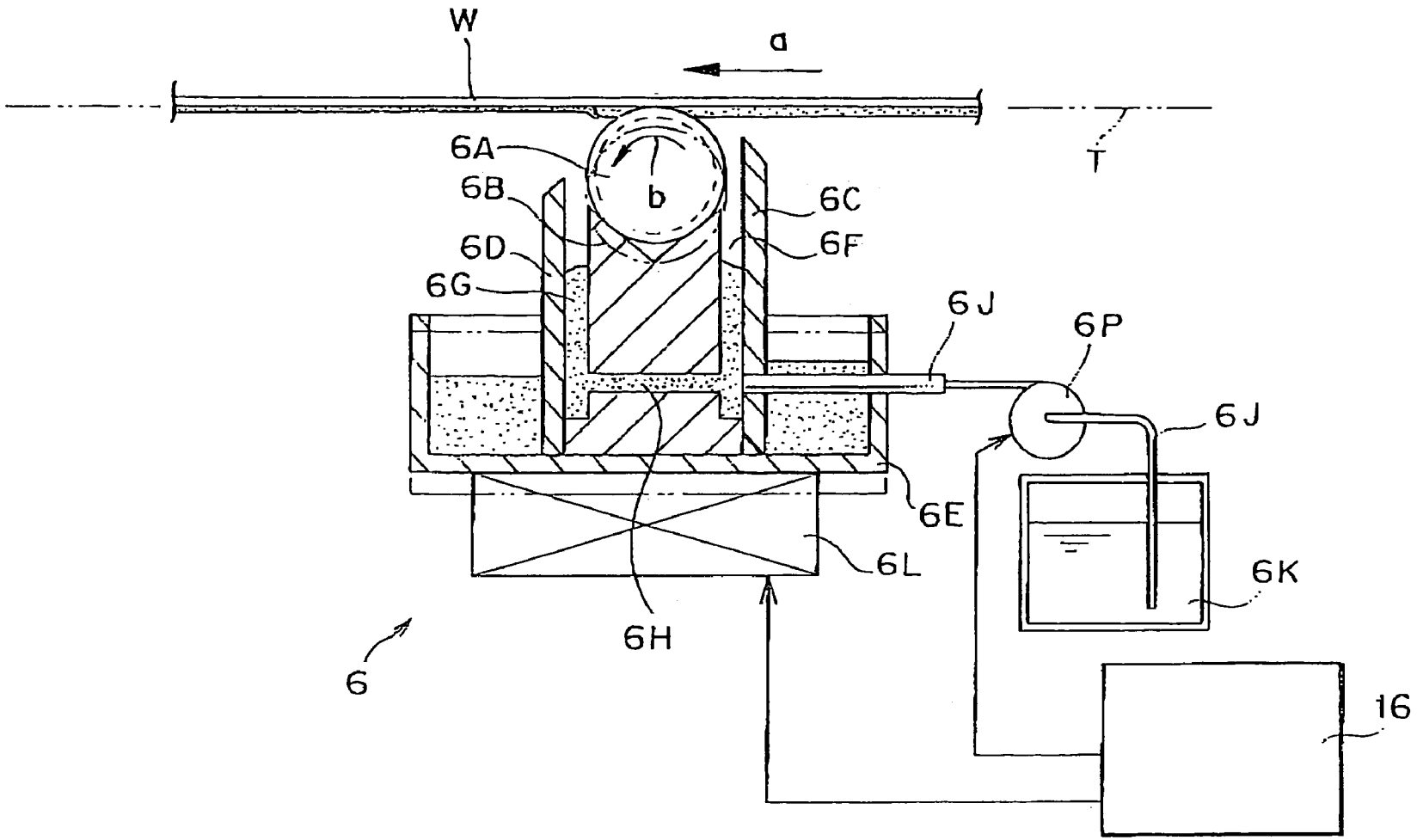
FIG. 5 is a partially enlarged view showing the structure of a pre-wet liquid coating device which forms the coating apparatus according to the first embodiment of the present invention, in a state in which it runs out of the pre-wet liquid.

Further, when the contact signal generated in the removal/contact signal generating section 12 is inputted to the pre-wet liquid coating device control section 16 at the time of restarting coating in the first coating device 2, the pre-wet liquid coating device control section 16 first stops the liquid-supply pump 6P after a newly-formed photosensitive layer arrives at the pre-wet liquid coating device 6. As a result, as shown in FIG. 5, the pre-wet liquid coating device 6 is brought into a state of running out of the liquid. Particularly, no pre-wet liquid reaches around the bar 6A, and therefore, a pool of the liquid formed between the bar 6A and the support web W is also eliminated. Subsequently, the pre-wet liquid coating device control section 16 outputs a drive signal to the lifting device 6L so as to remove the bar 6A of the pre-wet coating device 6 from the support web W. As a result, the lifting device 6L moves down the base 6E.

Incidentally, no member corresponding to the web pressing roller 2K is provided above the travel side surface T.

Next, the operation of the coating apparatus 100 will be described.

Figure 6:
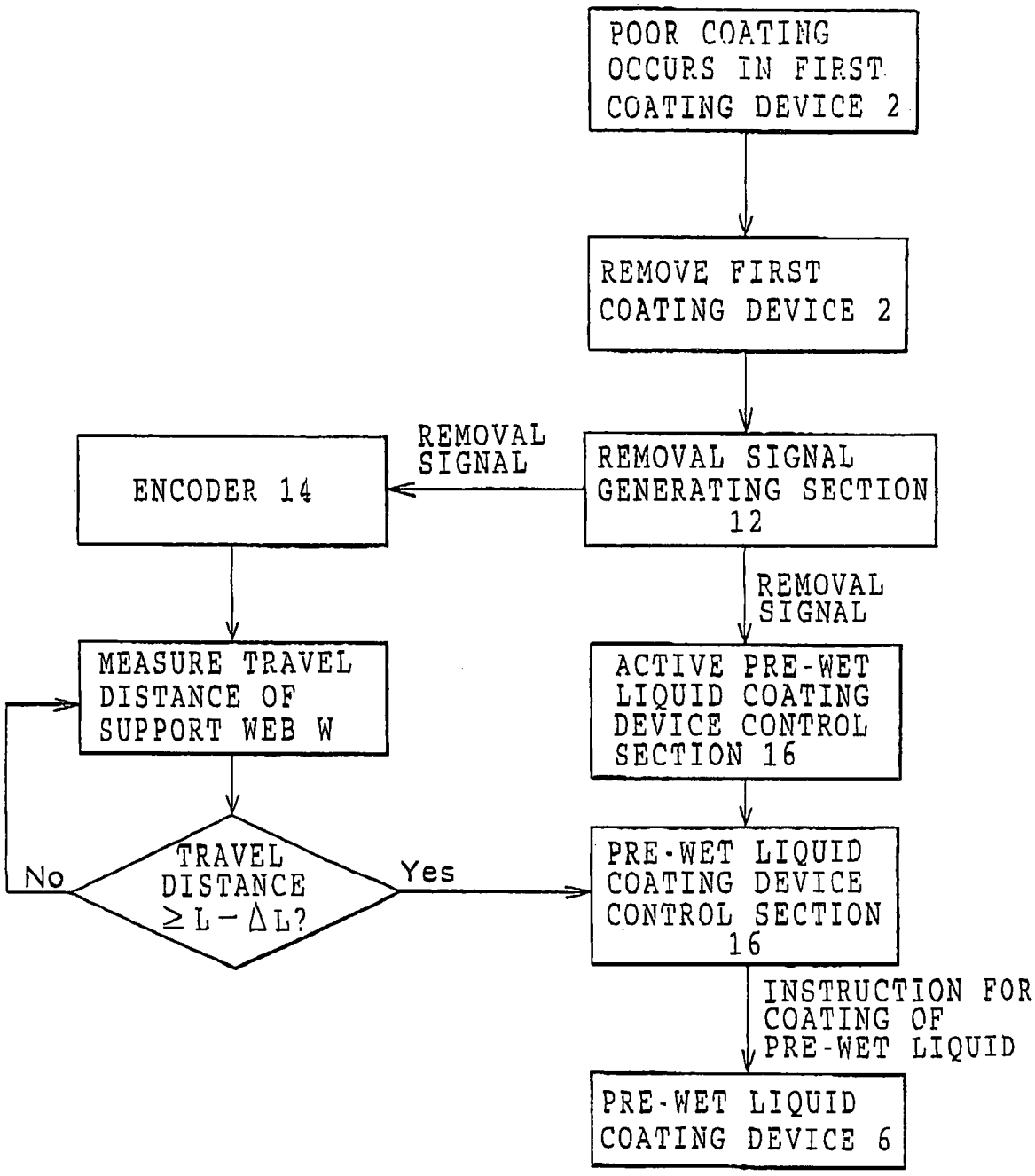
FIG. 6 is a flow chart which shows the flow of operation to application of pre-wet liquid when poor coating occurs in the first coating device in the coating apparatus according to the first embodiment of the present invention.

FIG. 6 shows the flow of operation when poor coating occurs in the first coating device 2.

As shown in FIG. 6, when poor coating occurs in the first coating device 2 and an uncoated portion is generated on the grained surface W2 of the support web W, in the same manner as described above, the lifting device 2L moves down the base 2E to remove the bar 2A from the support web W, and simultaneously, the lifting device 2L outputs, to the removal/contact signal generating section 12, an instruction so as to generate a removal signal indicating that the bar coater was removed.

The removal/contact signal generating section 12 generates a removal signal in response to the above-described instruction, and outputs the removal signal to the encoder 14 and also to the pre-wet liquid coating device control section 16.

The pre-wet liquid coating device control section 16 automatically activates in response to the removal signal and becomes ready to receive a signal from the encoder 14.

When the encoder 14 receives the above-described removal signal, it measures the distance d of the support web W travelling after the first coating device 2 is removed, and compares the distance L between the bar 2A and the bar 6A, and the travel distance d. When d becomes equal to "L−?L" or more, the encoder 14 outputs, to the pre-wet liquid coating device control section 16, a signal which indicates that d became equal to "L−?L" or more. Here, ?L is a length shorter than L and can be arbitrarily determined in accordance with the conveying speed of the support web. W, the speed of response of the pre-wet liquid coating device 6 to an instruction from the pre-wet liquid coating device control section 16, and the like. When the travel distance d became equal to "L−?L", the above-described uncoated portion is near to the bar 6A.

When the pre-wet liquid coating device control section 16 receives, from the encoder 14, the signal indicating that the travel distance d became equal to "L−?L", it outputs, to the pre-wet liquid coating device 6, an instruction so as to coat the pre-wet liquid.

When the pre-wet coating device 6 receives the above-described instruction, the bar 6A moves upward by the lifting table 6C and moves close to the grained surface W2 of the support web W. Then, the liquid-supply pump 6P activates to cause the pre-wet liquid to be discharged upward from the top of a coating head, and the pre-wet liquid is coated to the grained surface W2.

When poor coating in the first coating device 2 is solved and the base 2E moves upward to cause the bar 2A to abut against the support web W, thereby allowing coating of the photosensitive-layer forming liquid to restart, a signal indicating that the coating restarts is transmitted via the removal/contact signal generating section 12 to the encoder 14 and also to the pre-wet liquid coating device control section 16.

The encoder 14, when receiving the above-described signal, carries out again measurement of the travel distance of the support web W. When the travel distance d' after receiving that signal comes to L, the encoder 14 outputs, to the pre-wet liquid coating device control section 16, a signal indicating that the travel distance d' equals to L. When the pre-wet liquid coating device control section 16 receives the above-described signal, it outputs, to the pre-wet liquid coating device 6, a signal indicating that coating of the pre-wet liquid must be stopped. First, the pre-wet liquid coating device control section 16 stops the liquid-supply pump 16 after a newly-formed photosensitive layer arrives at the pre-wet liquid coating device 6. As a result, as shown in FIG. 5, the pre-wet liquid coating device 6 is brought into a state of running out of the liquid. Particularly, the pre-wet liquid reaches around the bar 6A no more, and therefore the pool of liquid formed between the bar 6A and the support web W is eliminated. Subsequently, the pre-wet liquid coating device control section 16 outputs a drive signal to the lifting device 6L so as to remove the bar 6A of the pre-wet liquid coating device 6 from the support web W. As a result, the lifting device 6L moves down the base 6E. Thus, coating of the pre-wet liquid on the support web W is stopped.

When poor coating occurs at a time of forming the photosensitive layer L1 by coating the photosensitive-layer forming liquid to the support web W, an uncoated portion is formed on the support web W and an anodic oxide layer is exposed. As described above, the antioxidant-layer forming liquid has poor wettability to the anodic oxide layer, and when no pre-wet liquid is coated, the antioxidant-layer forming liquid is repelled at the uncoated portion, as shown in FIG. 7B. Even if poor coating in the photosensitive-layer forming layer L1 is solved, no uniform coating of the antioxidant-layer forming liquid can be obtained.

Figure 7A:
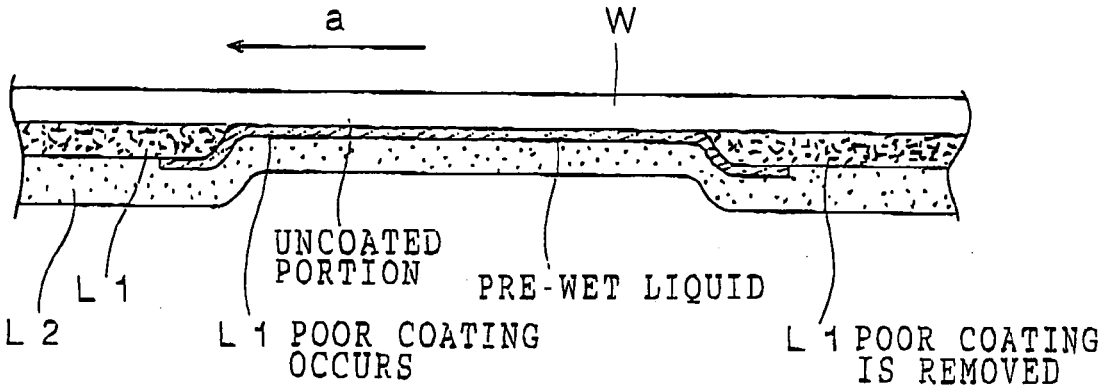
FIGS. 7A and 7B are cross sectional views which illustrate whether the pre-wet liquid is coated or not when an uncoated portion is generated on a support web.
Figure 7B:
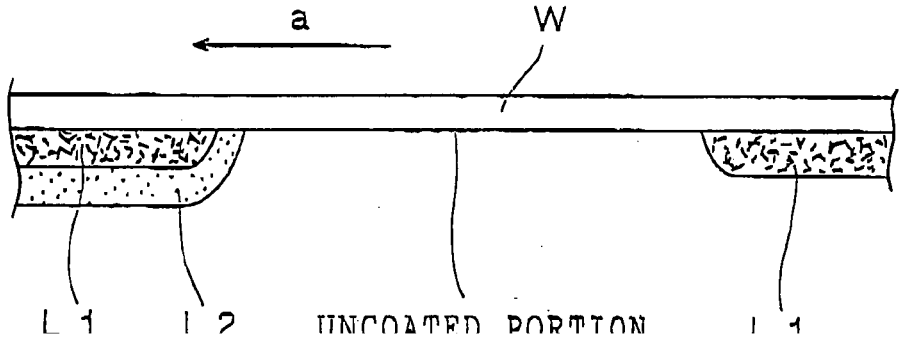

On the contrary, in the coating apparatus 100 according to the first embodiment, due to the pre-wet liquid being coated, the antioxidant layer L2 is continuously formed even in the uncoated portion as shown in FIG. 7A. If only poor coating in the photosensitive-layer forming layer L1 is solved, a two-layered coating film comprised of the photosensitive layer L1 and the antioxidant layer L2 is stably formed again.

Accordingly, in the coating apparatus 100, even if an uncoated portion is formed in the photosensitive layer L1, there is no possibility that poor forming or an uncoated portion occurs in the antioxidant layer L2 placed on the photosensitive layer L1.

Further, in the coating apparatus 100, the pre-wet liquid coating device 6 is activated using the removal signal indicating that the first coating device 2 is moved away from the position to be coated. Therefore, it is not necessary to provide an uncoated portion detecting device which detects occurrence of an uncoated portion in the photosensitive layer L1.

Moreover, in the coating apparatus 110, when coating of the pre-wet liquid by the pre-wet liquid coating device 6 is stopped, the liquid-supply pump 6P is first stopped, and the pre-wet liquid coating device 6 is brought into a state of running out of the liquid. Thereafter, the bar 6A is removed from the support web W. In a case in which the bar 6A is removed from the support web W without carrying out the above method, that is, without making the pre-wet coating device 6 into a state of running out of the liquid, the pool of liquid formed between the bar 6A and the support web W is not eliminated. As a result, there is a possibility that the pre-wet liquid which forms the pool of liquid adheres to the support web W, and a so-called thickly coated portion is thereby generated. The thickly coated portion may not be sufficiently dried, for example, even after passing through the antioxidant layer drying device 10, and therefore, the quality of a finished planographic printing plate may be deteriorated. Further, in a case in which an undried pre-wet liquid adheres to other members and the like, an operating process becomes unstable. In addition, in that case, there may be cases in which manufacturing of planographic printing plates is temporarily stopped and the adherent pre-wet liquid needs to be removed. As a result, operating efficiency may be deteriorated. In the coating apparatus 100 of the present embodiment, the pool of liquid between the bar 6A and the support web W is eliminated by making the pre-wet liquid coating device 6 into a state of running out of the liquid, and thereafter, the bar 6A is removed from the support web W. Accordingly, no thickly coated portion of the pre-wet liquid is generated on the support web W, and none of the above-described problems occurs. As a result, the quality of finished planographic printing plates can be made stable. Further, the operating process can be stabilized and no deterioration in the operating efficiency also occurs.

In the foregoing, the pre-wet liquid coating device 6 is brought into a state of running out of the liquid by stopping the liquid-supply pump 6P, but the structure in which the pre-wet liquid coating device 6 is brought into a state of running out of the liquid is not limited to the same. For example, the liquid supplying pipe line 6J is generally provided with a valve. In this case, the pre-wet liquid is not allowed to be supplied to the pre-wet liquid coating device 6 by closing the valve, so that the pre-wet liquid coating device 6 may be brought into a state of running out of the liquid.

Further, by controlling the number of rotation of the bar 6A as shown in the second embodiment described below, the pre-wet liquid coating device 6 can be substantially brought into a state of running out of the liquid.

Figure 8:
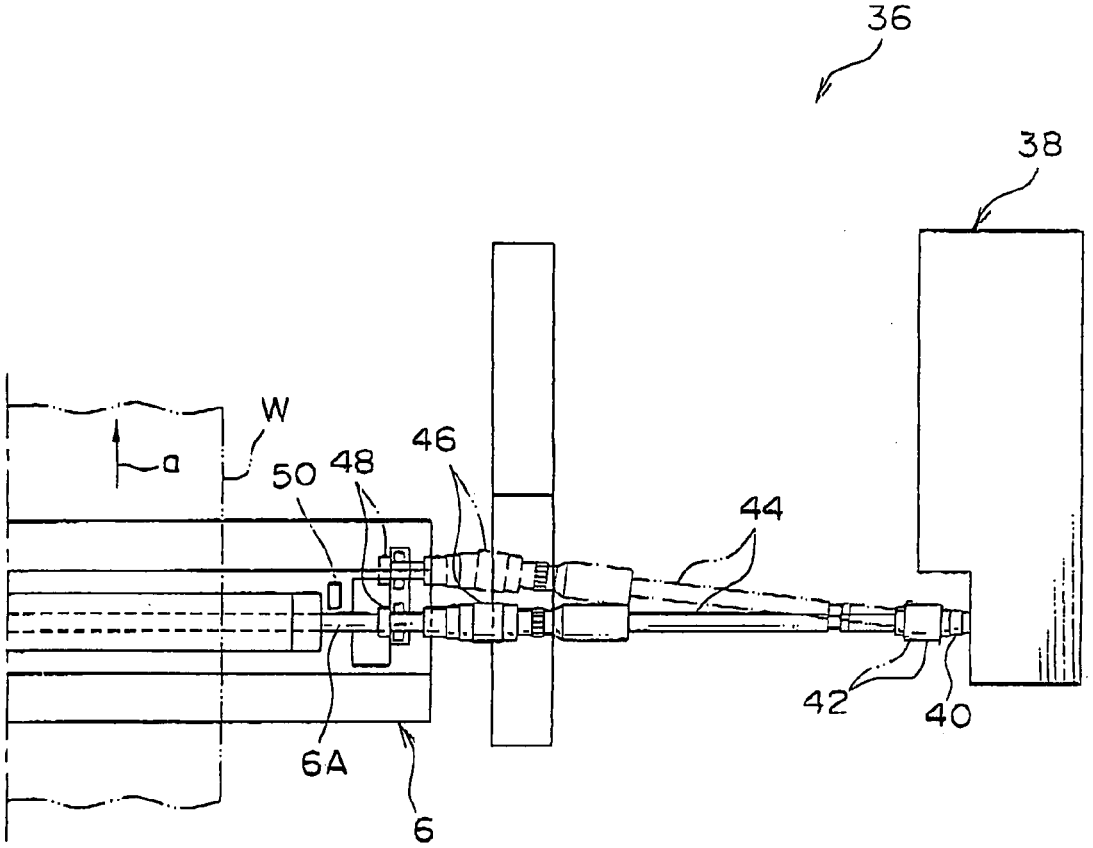
FIG. 8 is a plan view showing a rotating-driving device which drives a bar in a pre-wet liquid coating device which forms a coating apparatus according to a second embodiment of the present invention.
Figure 9:
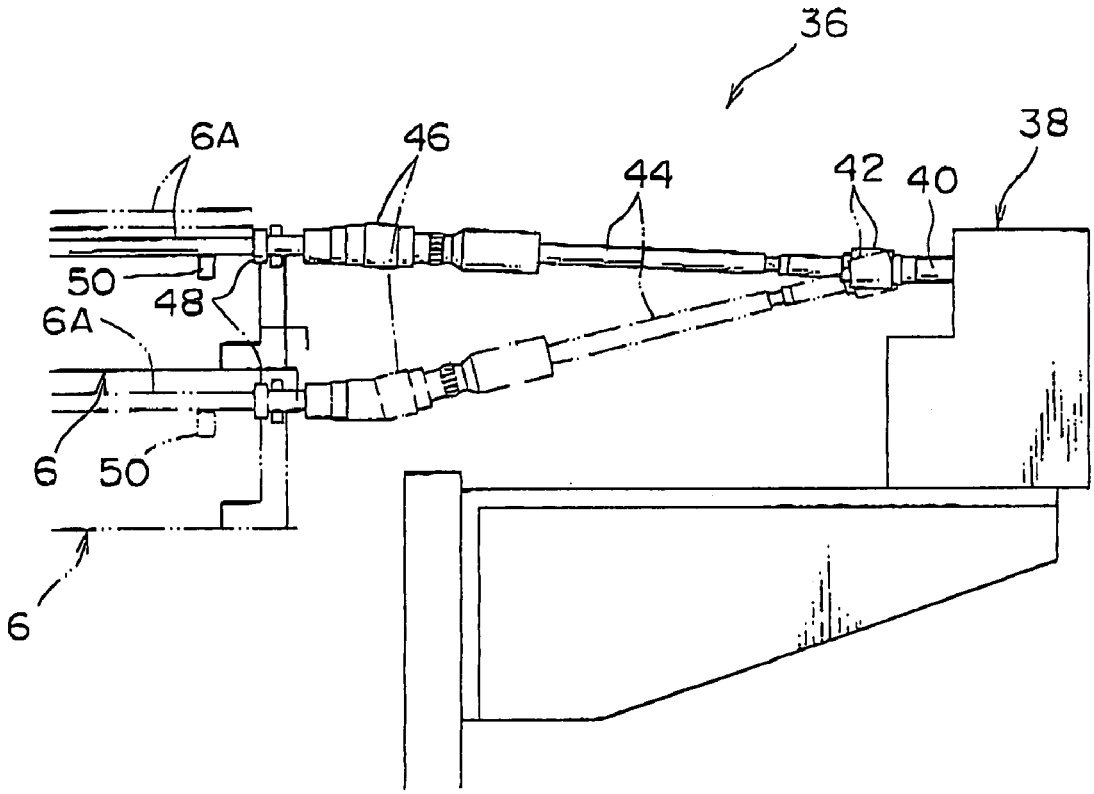
FIG. 9 is a front view showing a rotating-driving device which drives a bar in a pre-wet liquid coating device which forms a coating apparatus according to the second embodiment of the present invention.

FIGS. 8 and 9 show a rotating-driving device 36 in a coating apparatus of the second embodiment of the present invention. The coating apparatus of the second embodiment is different from the coating apparatus 100 of the first embodiment only in a point that the bar 6A of the pre-wet liquid coating device 6 (see FIGS. 1 and 4) which is similar to that of the first embodiment is driven by the rotating-driving device 36. The overall construction of the coating apparatus is substantially the same as the coating apparatus 100 of the first embodiment, and therefore the drawings thereof are omitted.

The rotating-driving device 36 is structured, including a motor, a speed reducer and the like, and also includes a drive source 38 which generates rotating-driving force at predetermined torque and angular speed. A shaft 44 is connected to an output shaft 40 of the drive source 38 via a first universal wrist unit (joint) 42, and the shaft 44 is also connected to a switching member 48 via a second universal wrist unit (joint) 46. The switching member 48 is provided so as to move between a position at which it is connected to the bar 6A to allow transmission of rotating-driving force (that is, the position indicated by the solid line in FIG. 8), and a position at which it is disconnected from the bar 6A so as not to transmit rotating-driving force (that is, the position indicated by the two-dot chain line in FIG. 8).

In this way, the drive source 38 and the bar 6A are connected together via the two universal wrist units. Therefore, the rotating-driving force of the drive source 38 can be transmitted to the bar 6A while constantly maintaining the angle of the bar 6A to the output shaft 40 of the drive source 38 at a fixed value (in the present embodiment, maintaining in parallel). For example, even when the pre-wet liquid coating device 6 is slightly moved up and down or when the pre-wet liquid coating device 6 is moved down to remove the bar 6A from the support web W as indicated by the two-dot chain line in FIG. 9, the bar 6A can be rotated by the rotating-driving force of the drive source 38 with the output shaft 40 of the drive source 38 and the bar 6A being maintained in parallel.

The drive source 38 has a clutch (not shown) which is controlled by the pre-wet liquid coating device control section 16. This clutch allows the rotating-driving force from the drive source 38 to be transmitted to the bar 6A so that the bar 6A may be rotated at a predetermined specific number of rotation (angular speed of rotation). The specific number of rotation mentioned herein is set at a value which does not allow bringing upward the pre-wet liquid by the bar 6A (that is, the pre-wet liquid coating liquid 6 is substantially brought into a state of running out of the liquid and no pre-wet liquid can be coated to the support web W), but does not completely stop rotation of the bar 6A.

Further, the rotating-driving device 36 is provided with a brake 50 which reduces the rotational speed of the bar 6A. The brake 50 is controlled by the pre-wet liquid coating device control section 16.

When the rotational speed of the bar 6A is not reduced by the brake 50, the clutch (not shown) does not transmit the rotating-driving force to the bar 6A and the bar 6A is driven to rotate due to friction with respect to the support web W. On the other hand, when the rotational speed of the bar 6A is reduced by the brake 50, the number of rotation of the bar 6A gradually decreases. When the number of rotation of the bar 6A reaches the above-described specific number of rotation, reduction of speed of the bar 6A by the brake 50 is stopped, and the rotating-driving force is transmitted by the clutch to the bar 6A thereby causing the bar 6A to rotate at the specific number of rotation due to the rotating-driving force of the drive source 38.

In the coating apparatus of the second embodiment having the above-described structure as well, the pre-wet liquid is coated to the support web W in the same manner as in the coating apparatus 100 of the first embodiment.

Further, when coating of the pre-wet liquid for the support web W is stopped, first, the rotational speed of the bar 6A is reduced by the brake 50 and the bar 6A is rotated at the specific number of rotation. As a result, the pre-wet liquid coating device 6 is brought into a state of running out of the liquid. Thereafter, the pre-wet liquid coating device 6 is removed from the support web W. Accordingly, the quality of planographic printing plates to be obtained can be made stable without forming a thickly coated portion of the pre-wet liquid on the support web W as is the case with the first embodiment. Further, the operating process can be stabilized and no deterioration in the operating efficiency occurs.

In the present invention, the structure in which the pre-wet liquid coating device 6 is moved close to or away from the support web W having an uncoated portion formed thereon, in such a manner as to correspond to the uncoated portion is not limited to the above-described one.

Figure 10:
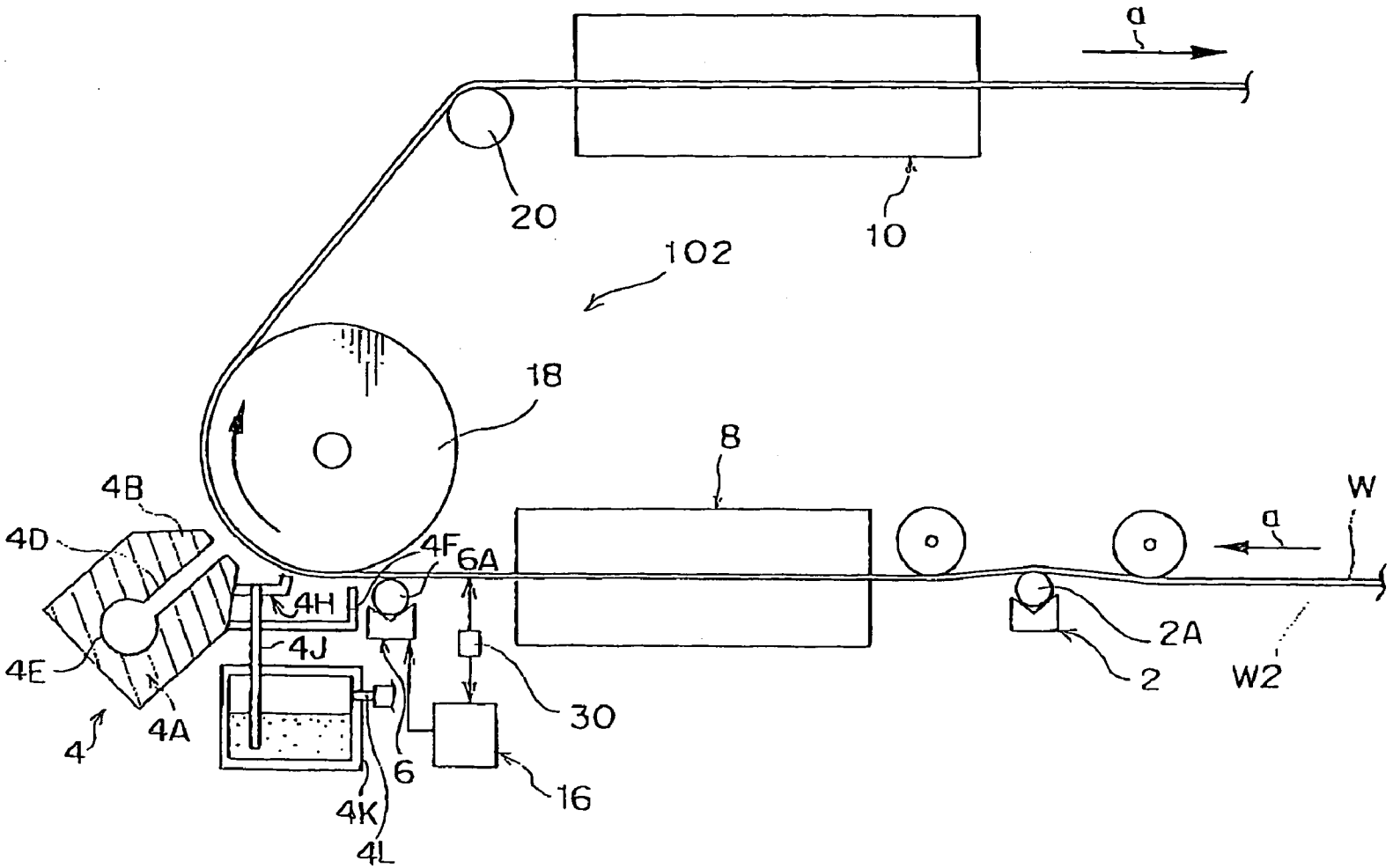
FIG. 10 is a schematic diagram showing a coating apparatus according to a third embodiment of the present invention.

FIG. 10 shows, as a third embodiment of the present invention, a coating apparatus 102 in which an uncoated-portion detecting device 30 for detecting occurrence of an uncoated portion is provided between the photosensitive layer drying device 8 and the pre-wet liquid coating device 6. The coating apparatus 102 is different from the coating apparatus 100 of the first embodiment in a point that the pre-wet liquid coating device 6 is moved close to or away from the support web W based on information of the uncoated portion detected by the uncoated-portion detecting device 30. In this structure, the pre-wet liquid can be reliably coated to the uncoated portion, and further, no pre-wet liquid is coated to a portion having a photosensitive layer formed thereon, thereby making it possible to efficiently coat a lower amount of the pre-wet liquid.

In the structure of the third embodiment, as the uncoated-portion detecting device 30, a light emitting/receiving element having a light emitting element (for example, a light emitting diode) and a light receiving element (for example, a photodiode or a photo-transistor) integrated with each other, and the like can be used. The above-described light emitting element preferably emits red light or infrared light (or light having wavelength between those of red light and infrared light)

Particularly, the photosensitive-layer forming liquid to be coated by the first coating device 2 contains, in addition to a photosensitive resin, various pigments or dyes, and may be colored in dark green to dark blue. In this case the photosensitive layer L1 formed by coating the photosensitive-layer forming liquid is also colored in similar color. Accordingly, when the photosensitive layer L1 is uniformly formed on the support web W, light emitted from a light emitting element in the uncoated-portion detecting device 30 toward the photosensitive layer L1 is almost completely absorbed by the photosensitive layer L1 and almost no light is reflected toward a light receiving element of the uncoated-portion detecting device 30.

On the other hand, when poor coating occurs by the first coating device 2 and an uncoated portion is generated on the photosensitive layer L1, a metal surface of the support web is exposed. Therefore, light emitted from the light emitting element in the uncoated-portion detecting device 30 is reflected by the uncoated portion and made incident on the light receiving element. The uncoated-portion detecting device 30 can detect the uncoated portion by detecting the above-described incident light.

In the structure having the uncoated-portion detecting device 30 which detects occurrence of an uncoated portion as in the coating apparatus 102 of the third embodiment, the pre-wet liquid coating device 6 may be structured as in the second embodiment, that is, in such a manner as to be brought into a state of running out of the liquid by reducing the rotational speed of the bar 6A.

As the bars 2A and 6A of the present invention a bar having a flat peripheral surface, a wire bar in which a wire is closely wound in a circumferential direction of a bar peripheral surface and grooves are formed between adjacent wire portions, a groove-cutting bar in which grooves are formed throughout the width of the bar in a circumferential direction of the bar peripheral surface or in a required portion, and the like can be used. The outside diameter of the bars 2A and 6A is preferably in the range of $\phi 1$ to 30 mm from the viewpoint of bar rolling accuracy (complete straightness/completeroundness), rotational moment and weight balance, and more preferably in the range of $\phi 6$ to 20 mm.

The bar supporting members 2B and 6B are not limited if only they can reliably support the bars 2A and 6A, respectively. However, a bar supporting member having a low coefficient of friction with respect to the bars 2A and 6A is preferably used in smooth rotation of the bars 2A and 6A, and a bar supporting member having a high wear resistance is further preferably used. Materials which satisfy these conditions include a polyethylene resin, a fluorocarbon resin, a polyacetal resin, and the like. Among them, polytetrafluoro-ethylene known as Teflon (trademark; product name of DuPont in U.S.A.) and polyacetal resin known as Delrin (product name of DuPont in U.S.A.) are particularly suitable in terms of coefficient of friction, and strength (wear resistance). Further, a filler such as glass fiber, graphite, molybdenum disulfide or the like added to the above-described plastic material can also be used. Moreover, after the bar supporting members 2B and 6B are each made of metallic materials, the above-described plastic material is coated or adhered to the surface of each bar supporting member (a portion which at least supports the bar 2A, 6A), so as to reduce the coefficient of friction between the bars 2A and 6A. Alternatively, various metallic materials impregnated with the above-described plastic materials (for example, aluminum impregnated with polytetrafluoro-ethylene) can also be used for the bar supporting members 2B and 63.

The second coating device (the downstream-side coating section) of the present invention, that is, a coating device for forming an uppermost film layer was described above using a so-called die coater by way of example, but the present invention is not limited to the same. For example, various coating devices such as a bar coater, a slide hopper, a curtain coating device, or the like can be used.

Further, a base material used as an object to be coated (support) by the coating device of the present invention may be formed in the shape of strip or sheet. A thin-plate metal such as aluminum (the above-described support web W made of aluminum), paper, plastic film, resin-coated paper, synthetic paper and the like can be used. When an aluminum plate is used as the support for a planographic printing plate, for example, JIS 1050 material, JIS 1100 material, JIS 1070 material, Al—Mg based alloy, Al—Mn based alloy, Al—Mn—Mg alloy, Al—Zr based alloy, Al—Mg—Si based alloy, and the like are applicable. When a plastic film is used as the support, polyolefin such as polyethylene or polypropylene, vinyl polymers such as polyvinyl acetate, polyvinyl chloride or polystyrene, polyamide such as 6,6-nylon or 6-nylon, polyester such as polyethylene terephthalate or polyethylene-2,6-naphthalate, cellulose acetate such as polycarbonate, cellulose triacetate or cellulose diacetate, and the like are used as-materials of the plastic film. Further, a typical resin used for the resin-coated paper is polyolefin such as polyethylene, but the present invention is not limited to the same.

The thickness of the support web W is not particularly limited, but it is advantageous in the range of about 0.01 mm to 1.0 mm in terms of handling or versatility.

Further, as the photosensitive-layer forming liquid, for example, an aqueous solution of a high polymer compound, an organic solvent solution, pigment dispersant, colloidal solution or the like can be used. Examples of the photosensitive-layer forming liquid used to form a photosensitive layer of a planographic printing plate includes photosensitive solutions used to form photosensitive layers having the following aspects (1) to (11):

(1) a photosensitive layer containing an infrared ray absorbent, a compound which produces an acid by heat, and a compound which cross-links by the addition of an acid;

(2) a photosensitive layer containing an infrared ray absorbent, and a compound which becomes alkali-soluble by heat;

(3) a photosensitive layer containing a compound which generates a radial by irradiation of laser light, a bind soluble in alkali, a layer including a multifunctional monomer or prepolymer, and an oxygen blocking layer;

(4) a photosensitive layer comprising a physical development center layer and a silver halide emulsion layer;

(5) a photosensitive layer containing a polymer layer including a multifunctional monomer and a multifunctional binder, a layer including silver halide and a reducing agent, and an oxygen blocking layer;

(6) a photosensitive layer containing a layer including a novolak resin and naphthoquinone diazide, and a layer including silver halide;

(7) a photosensitive layer containing an organic photoconductor;

(8) a photosensitive layer containing a laser light absorption layer removed by irradiation of laser light, and a lipophilic layer and/or a hydrophilic layer;

(9) a photosensitive layer containing a compound which generates an acid by absorbing energy, a high polymer compound having a functional group which generates sulfonic acid or carboxylic acid by addition of an acid, at a side chain, and a compound which imparts energy to an acid generator by absorbing visible light;

(10) a photosensitive layer containing a quinone diazide compound and a novolak resin; and

(11) a photosensitive layer containing a compound which is decomposed by light or ultraviolet radiation to form a cross-linking structure with itself or other molecules in the layer, and a binder soluble in alkali.

EXAMPLES

The present invention will be described in greater detail with reference to the following examples.

In each of the following examples and comparative examples, an aluminum plate having a transverse dimension of 1000 mm was subjected to required processing such as graining, etching, electrolytic surface roughening, and anodic oxidation, to thereby obtain a support web W. A photosensitive-layer forming liquid was coated to the support web W using a coating apparatus to thereby form a photosensitive layer, and an antioxidant-layer forming liquid was coated thereto to form an antioxidant layer. A pre-wet liquid was coated to an uncoated portion of the photosensitive-layer forming liquid by the pre-wet liquid coating device 6. Then, the presence of a thickly coated portion of the pre-wet liquid, and the quality of a coated surface of a planographic printing plate were evaluated.

In the pre-wet liquid coating device 6, the bar 6A having a widthwise (axial) dimension of 1600 mm was used.

The composition of each of the photosensitive-layer forming liquid, the antioxidant-layer forming liquid, and the pre-wet liquid used in these examples and comparative examples are shown in Table 1.

TABLE 1

| | Viscosity (mPa · s) | Specific gravity | Surface tension (μN/m$^2$) | Principal component | Amount of coating (cm$^3$/m$^2$) |
|---|---|---|---|---|---|
| Photosensitive-layer forming liquid | 0.7 to 2 | 0.828 to 0.88 | 220 to 230 | Organic solvent solution of photosensitive resin | 18.75 ± 1 |
| Antioxidant-layer forming liquid | 7 to 10 | 1.014 ± 0.002 | 300 to 340 | PVA aqueous solution (containing fluorine based surface active agent) | 42 ± 3 |
| Pre-wet liquid | 0.6 to 1 | 1.002 | 300 to 340 | 0.1% aqueous solution of the above fluorine based surface active agent | 7.5 ± 0.5 |

In each of these examples and comparative examples, when the pre-wet liquid coating device 6 is removed from the support web W, the state of a removal region in which the pre-wet liquid coating device 6 is removed from the support web W (that is, a portion in which the bar 6A and the support web W contacts each other, and its vicinities), and the quality of the coated surface of a finished planographic printing plate were evaluated. The condition for causing the pre-wet liquid coating device to run out of the liquid, the state of the removal region, and evaluation about the quality of the coated surface are shown in Table 2.

TABLE 2

| | Number of rotation of bar (/min) | Amount of liquid supplied (L/min) | State of removal region: Occurrence of no liquid | State of removal region: Thickly coated portion | Evaluation of the quality of coated surface |
|---|---|---|---|---|---|
| Comparative Example 1 | 1500 | 1.5 | None | Occur | X |
| Example 1 | 1500 | 1.5→0 | Occur | None | ○ |
| Example 2 | 1500→5 | 1.5 | Occur | None | ○ |
| Example 3 | 1500→5 | 1.5 | Occur | None | ○ |

In the evaluation about the quality of the coated surface shown in Table 2, "○" means that the quality of the coated surface is excellent and no problem arises from a practical standpoint; "X" means that the quality of the coated surface is deteriorated to such an extent that some problem practically arises depending on use conditions.

Example 1

In example 1, a photosensitive layer was formed by coating a photosensitive-layer forming liquid to the support web W using a first coating device 2 in the coating apparatus 100 of the first embodiment. An antioxidant-layer forming liquid was coated thereto by the second coating device 4 to thereby form an antioxidant layer. The pre-wet liquid was coated by the pre-wet liquid coating device 6 to an uncoated portion of the photosensitive-layer forming liquid. Just before the pre-wet liquid coating device 6 is removed from the support web W, the liquid-supply pump 6P was stopped so that the amount of liquid supplied was changed from 1.5 L/min to 0 L/min, thereby making the pre-wet liquid coating device 6 into a state of running out of the liquid.

As shown in Table 2, no thickly coated portion of the pre-wet liquid was generated in the removal region, and the quality of the coated surface of a planographic printing plate was excellent.

Example 2

In example 2, a photosensitive layer and an antioxidant layer were formed using the coating apparatus of the second embodiment in the same manner as in the first embodiment. Further, the pre-wet liquid was coated by the pre-wet liquid coating device 6 to the uncoated portion of the photosensitive-layer forming liquid. Just before the pre-wet liquid coating device 6 is removed from the support web W, the, number of rotation of the bar 6A was reduced from 1500/min to 5/min, thereby making the pre-wet liquid coating device 6 into a state of running out of the liquid.

As shown in Table 2, in this example as well as in Example 1, no thickly coated portion of the pre-wet liquid occurs in the removal region, and the quality of the coated surface of a planographic printing plate was excellent.

Example 3

A photosensitive layer and an antioxidant layer were formed using the coating apparatus of the second embodiment substantially in the same manner as in the second embodiment. Further, the pre-wet liquid was coated by the pre-wet liquid coating apparatus 6 to the uncoated portion of the photosensitive-layer forming liquid. Just before the pre-wet liquid coating device 6 was removed from the support web W, the number of rotation of the bar 6A was reduced from 1500/min to 0/min so that the bar 6A would be completely stopped, thereby making the pre-wet liquid coating device 6 into a state of running out of the liquid.

As shown in Table 2, in this example as well as with Example 1, no thickly coated portion of the pre-wet liquid occurs in the removal region, and the quality of the coated surface of a planographic printing plate was excellent. However, the support web W was transported in a state in which the bar 6A was completely stopped, and therefore, the bar 6A was partially in friction with the support web W. As a result, the bar 6A was partially worn to such an extent that further use thereof is impossible.

Comparative Example 1

In this comparative example, a photosensitive layer and an antioxidant layer were formed using the coating apparatus 1 of the first embodiment substantially in the same manner as in Example 1. The pre-wet liquid was coated by the pre-wet liquid coating device 6 to the uncoated portion of the photosensitive-layer forming liquid. However, when the pre-wet liquid coating device 6 is removed from the support web W, the amount of the liquid supplied was maintained at 1.5 L/min without stopping the liquid-supply pump 6P, and the pre-wet liquid coating device 6 was not made into a state of running out of the liquid.

As shown in Table 2, in this comparative example, a thickly coated portion of the pre-wet liquid was generated in the removal region, and the quality of the coated surface of a planographic printing plate was deteriorated.

Since the present invention has the above-described structure, even if poor coating occurs in a lower layer, no poor coating occurs in an upper layer formed on the lower layer.

What is claimed is:

1. A coating apparatus which forms a plurality of layers on a continuously travelling base material, comprising:

an upstream-side coating section which coats a first coating liquid to the base material to form a lower layer;

a downstream-side coating section disposed at the downstream side of the upstream-side coating section in a direction to which the base material is conveyed, and coating, onto the lower layer, a second coating liquid of which composition is the same as or different from that of the first coating liquid, to thereby form an upper layer;

an undercoat liquid coating section disposed so as to move close to or away from the base material, when an uncoated portion, which is a portion to which no first coating liquid is coated, is generated at a time of forming the lower layer, the undercoat liquid coating section being contacted the base material before the uncoated portion reaches the undercoat liquid coating section, and coating an undercoat liquid to the uncoated portion, and when coating of the first coating liquid is restarted, the undercoat liquid coating section being removed from the base material after a lower layer formed again reaches the undercoat liquid coating section, and stopping coating of the undercoat liquid; and a liquid run-out section which, at the latest, just before the undercoat liquid coating section is removed from the base material, stops coating of the undercoat liquid for the base material by making the undercoat liquid coating section into a state of running out of the liquid;

wherein the undercoat liquid coating section is formed as a bar coating device including an undercoating bar which rotates in contact with the base material to coat the undercoat liquid thereto; and the liquid run-out section is formed as a speed reducer which makes the bar coating device into a state of running out of the liquid by reducing the number of rotations of the undercoating bar.

2. A coating apparatus according to claim 1, wherein the liquid run-out section is formed as a liquid-supply stopping section which makes the undercoat liquid coating section into a state of running out of the liquid by stopping supply of the liquid to the undercoat liquid coating section.

3. A coating apparatus according to claim 1, further comprising an uncoated-portion detecting section which detects occurrence of the uncoated portion at the time of forming the lower layer, wherein the undercoat liquid coating section coats the undercoat liquid to the uncoated portion when the uncoated-portion detecting section detects occurrence of the uncoated portion.

4. A coating apparatus according to claim 1, wherein the speed reducer makes the bar coating device into a state of running out of the liquid without stopping rotating of the undercoating bar.

5. A coating apparatus which forms a plurality of layers on a continuously travelling base material, comprising:

an upstream-side coating section which coats a first coating liquid to the base material to form a lower layer;

a downstream-side coating section disposed at the downstream side of the upstream-side coating section in a direction to which the base material is conveyed, and coating, onto the lower layer, a second coating liquid of which composition is the same as or different from that of the first coating liquid, to thereby form an upper layer;

an undercoat liquid coating section disposed so as to move close to or away from the base material, when an uncoated portion, which is a portion to which no first coating liquid is coated, is generated at a time of forming the lower layer, the undercoat liquid coating section being contacted the base material before the uncoated portion reaches the undercoat liquid coating section, and coating an undercoat liquid to the uncoated portion, and when coating of the first coating liquid is restarted, the undercoat liquid coating section being removed from the base material after a lower layer formed again reaches the undercoat liquid coating section, and stopping coating of the undercoat liquid;

a liquid run-out section which, at the latest, just before the undercoat liquid coating section is removed from the base material, stops coating of the undercoat liquid for the base material by making the undercoat liquid coating section into a state of running out of the liquid;

a signal output section which outputs a signal relating to generation of the uncoated portion and a signal relating to restarting of coating of the first coating liquid;

a calculating section which, based on the signal from the signal output section, calculates a timing at which the uncoated portion reaches the undercoat liquid coating section and a timing at which the lower layer formed again reaches the undercoat liquid coating section; and a control section which, based on the calculating result of the calculating section, instructs coating the undercoat liquid on the uncoated portion or stopping of coating the undercoat liquid;

wherein the upstream-side coating section is disposed so as to move close to or away from the base material.

6. A coating apparatus according to claim 5, wherein the signal relating to generation of the uncoated portion and the signal relating to restarting of coating of the first coating liquid are a removal signal indicating the upstream-side coating section being away from the base material and a contact signal indicating the upstream-side coating section contacting the base material.

7. A coating apparatus which forms a plurality of layers on a continuously traveling base material, comprising:

an upstream-side coating section constructed and arranged to be capable of forming a lower layer on the base material by coating a first coating liquid on the base material;

a downstream-side coating section disposed downstream of the upstream-side coating section relative to a conveyance direction of the base material, the downstream-side coating section being constructed and arranged to be capable of forming an upper layer on the lower layer by coating a second coating liquid on the lower layer;

an undercoat liquid coating section disposed so as to be movable with respect to the base material, and controllable so as to coat the undercoat liquid to the base material in areas where the first coating liquid was not applied to the base material;

a liquid run-out section, which controls the undercoat liquid coating section so as to stop coating the undercoat liquid onto the base material;

wherein the undercoat liquid coating section comprises an undercoating bar that is positioned to allow rotation in contact with the base material to coat the undercoat liquid thereto; and the liquid runout section comprises a speed reducer that reduces a rate of coating the undercoat liquid onto the base material by reducing a rotational speed of the undercoating bar.

8. The coating apparatus of claim 7, further comprising:

a rotational drive source having a drive shaft; and a interconnecting shaft interconnecting the drive shaft and the undercoating bar;

wherein the interconnecting shaft is constructed and arranged so that the undercoating bar can be moved with respect to the base material while remaining parallel to the drive shaft of the rotational drive source.

9. A coating apparatus which forms a plurality of layers on a continuously traveling base material, comprising:

first coating means for forming a lower layer on the base material by applying a first coating liquid on the base material;

second coating means for forming an upper layer on the lower layer by applying a second coating liquid on the lower layer, the first and second coating means being arranged so that the base material travels from the first to the second coating means; and third coating means for an undercoat layer by applying an undercoating liquid to areas of the base material to which the lower layer was not applied by the first coating means, the third coating means comprising an undercoating bar that is capable of selectively transferring the undercoating liquid to the base material;

wherein the third coating means comprises a speed controller arranged to control a rotational speed of the undercoating bar, the speed controller being constructed and arranged to terminate transfer of the undercoating liquid to the base material by reducing the rotational speed of the undercoating bar without terminating rotation of the undercoating bar.

10. The coating apparatus of claim 9, wherein the speed controller comprises a brake and a drive source, the brake being arranged so as to reduce the rotational speed of the undercoating bar, the drive source being connected by a clutch to the undercoating bar to cause rotation of the undercoating bar.

11. The coating apparatus of claim 10, wherein the speed controller is constructed and arranged so that termination of the transfer of the undercoating liquid is achieved by applying the brake to the undercoating bar to slow rotation of the undercoating bar to a non-zero rotational speed at which the undercoating liquid is no longer transferred to the base material, and engaging the clutch so that the drive source maintains rotation of the undercoating bar at a non-zero rotational speed that does not transfer the undercoating liquid to the base material.

* * * * *